US010064473B2

(12) United States Patent
Julien et al.

(10) Patent No.: US 10,064,473 B2
(45) Date of Patent: Sep. 4, 2018

(54) COSMETIC PRODUCT DISPENSING HEAD COMPRISING A SCRAPING MEMBER, AND ASSOCIATED PACKAGING DEVICE

(71) Applicant: L'OREAL, Paris (FR)

(72) Inventors: Jean-Marie Julien, Marly-le-Roi (FR); Patrick Charnay, Polliat (FR); Gilles Baudin, Montigny-les-Cormeilles (FR); Patrice Barre, Antony (FR); Matthew Forrester, Bessancourt (FR)

(73) Assignee: L'OREAL, Paris (FR)

( * ) Notice: Subject to any disclaimer, the term of this patent is extended or adjusted under 35 U.S.C. 154(b) by 85 days.

(21) Appl. No.: 15/031,368

(22) PCT Filed: Oct. 20, 2014

(86) PCT No.: PCT/EP2014/072404

§ 371 (c)(1),
(2) Date: Apr. 22, 2016

(87) PCT Pub. No.: WO2015/059077

PCT Pub. Date: Apr. 30, 2015

(65) Prior Publication Data

US 2016/0278501 A1 Sep. 29, 2016

(30) Foreign Application Priority Data

Oct. 23, 2013 (FR) ..... 13 60329

(51) Int. Cl.
*A45D 40/00* (2006.01)
*B65D 51/22* (2006.01)
(Continued)

(52) U.S. Cl.
CPC ..... *A45D 40/0075* (2013.01); *B65D 47/121* (2013.01); *B65D 51/225* (2013.01); *A45D 34/00* (2013.01); *A45D 34/046* (2013.01)

(58) Field of Classification Search
CPC .... B65D 47/121; B65D 51/225; B65D 51/22; B65D 51/221; B65D 51/222; A45D 34/046; A45D 40/0075; A45D 34/00
See application file for complete search history.

(56) References Cited

U.S. PATENT DOCUMENTS

2005/0211579 A1* 9/2005 Makita ..... B65D 51/2842 206/219
2008/0073348 A1 3/2008 Pritikin et al.
(Continued)

FOREIGN PATENT DOCUMENTS

DE 10 2010 016054 B3 9/2011
EP 1 582 331 A1 10/2005
(Continued)

*Primary Examiner* — J. Casimer Jacyna
(74) *Attorney, Agent, or Firm* — Polsinelli PC

(57) ABSTRACT

This cosmetic product dispensing head (30) comprises:

Figure 2:
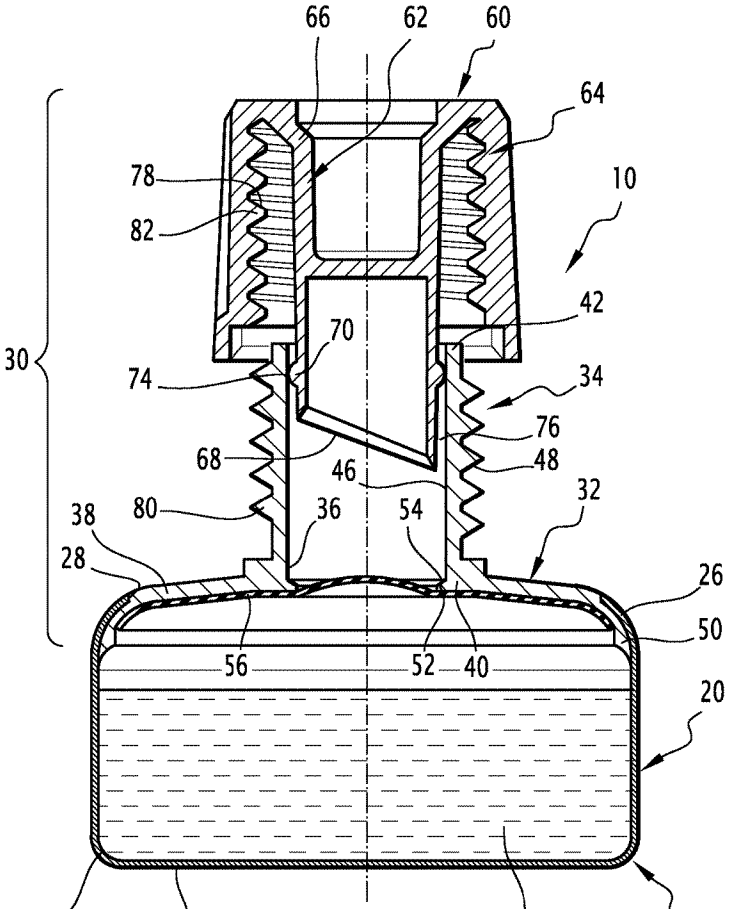

a dispensing member (32) for the cosmetic product, having a tubular duct (34) defining a passage (36) for the cosmetic product, and a stopper (60) for closing off the passage (36), movable between a position freeing the passage (36) and a position closing off the passage (36), the stopper (60) comprising a finger (62) and a skirt (64), the outer face (48) of the duct (34) and the inner face (78) of the skirt (64) having complementary cooperating means (80, 82) for securing the stopper (60) to the dispensing member (32).

The finger (62) bears a peripheral scraping member (70) protruding radially from a peripheral face (72) of the finger (62), the scraping member (70) having at least one perimeter line (74) suitable for being in contact with the duct (34) when the stopper (60) is in the closing off position.

14 Claims, 2 Drawing Sheets

(51) Int. Cl.

| | |
|---|---|
| ***B65D 47/12*** | (2006.01) |
| *A45D 34/00* | (2006.01) |
| *A45D 34/04* | (2006.01) |

(56) References Cited

U.S. PATENT DOCUMENTS

| | | | | |
|---|---|---|---|---|
| 2008/0304898 | A1* | 12/2008 | Fontana | A45D 34/042<br>401/134 |
| 2009/0321382 | A1* | 12/2009 | Fontana | B65D 51/225<br>215/329 |
| 2013/0008907 | A1 | 1/2013 | Weist | |

FOREIGN PATENT DOCUMENTS

| | | | |
|---|---|---|---|
| WO | WO-2006/008255 | A1 | 1/2006 |
| WO | WO-2007/144742 | A2 | 12/2007 |

* cited by examiner

COSMETIC PRODUCT DISPENSING HEAD COMPRISING A SCRAPING MEMBER, AND ASSOCIATED PACKAGING DEVICE

CROSS REFERENCE TO RELATED APPLICATIONS

This application is a National Phase filing under 35 U.S.C. § 371 of PCT/EP2014/072404 filed on Oct. 20, 2014; and this application claims priority to Application No. 1360329 filed in France on Oct. 23, 2013 under 35 U.S.C. § 119. The entire contents of each application is hereby incorporated by reference.

The present invention relates to a cosmetic product dispensing head, of the type comprising:

a dispensing member for the cosmetic product, having a tubular duct defining a passage for the cosmetic product, the duct having an outer face oriented opposite the passage, and a stopper for closing off the passage, movable between a position freeing the passage and a position closing off the passage, the stopper comprising a finger extending in the passage when the stopper is in the closing off position and a skirt extending around the duct when the stopper is in the closing off position, the skirt having an inner face oriented toward the finger, the outer face of the duct and the inner face of the skirt having complementary cooperating means for securing the stopper to the dispensing member.

The invention also relates to a cosmetic product packaging device closed by such a dispensing head.

Cosmetic product dispensing heads of the aforementioned type are known. Such heads are generally used to close the reservoir of a device for packaging a cosmetic product, for example a hair product, or a hygiene product, or a face and/or body care product, or a makeup product, or a sun protection product, so as to avoid oxidation or the loss of active ingredients from said cosmetic product. They also make it possible, when the stopper is in the free position, for the cosmetic product to leave the reservoir through the passage of the dispensing member, so that a user may use the cosmetic product.

The cosmetic product is more generally a product as defined in EC Regulation no. 1223/2009 by the European Parliament and the Council dated Nov. 30, 2009, relative to cosmetic products.

It is, however, difficult to produce good quality sealing between the stopper and the dispensing member. Consequently, the cosmetic product contained in the packaging device tends to oxidize, even when the stopper is in the closing position. This oxidation is particularly sensitive at the cosmetic product that has become deposited in the passage. The aesthetics and performance of the cosmetic product are decreased as a result.

Furthermore, residues with an unpleasant appearance for users may form in the passage or outside the dispensing head.

One aim of the invention is to reduce the risks of oxidation of a cosmetic product contained in a packaging device. Another aim is to limit the production costs necessary to resolve the aforementioned technical problem.

To that end, the invention relates to a dispensing head of the aforementioned type, in which the finger bears a peripheral scraping member protruding radially from a peripheral face of the finger, the scraping member having at least one perimeter line suitable for being in contact with the duct when the stopper is in the closing off position.

In particular embodiments of the invention, the dispensing head further has one or more of the following features, considered alone or according to any technically possible combination(s):

the finger has a junction end to the skirt and a free end, and the perimeter line is closer to the free end than the junction end;

the dispensing member has an annular protrusion protruding radially from the duct toward the inside of the passage, the protrusion defining a shoulder, and the scraping member is suitable for being in contact with said shoulder along a closed contour line when the stopper is in the closing off position;

the duct has an insertion end for inserting the finger into the passage and a connecting end for connecting the passage to a cosmetic product reservoir, opposite the insertion end, the annular protrusion protruding from said connecting end;

the dispensing head comprises an airtight and fluid-tight membrane seal tightly sealed to the dispensing member, the membrane seal being separate from the stopper, the membrane seal extending through or across from the passage;

the finger has a junction end to the skirt and a free end, the free end being suitable for perforating the membrane seal when the stopper is in the closing off position;

the free end is beveled so as to facilitate the perforation of the membrane seal;

the dispensing head comprises a removable safety member suitable for keeping the stopper in an intermediate position between its released and closing off positions, in which the free end of the finger is at a distance from the membrane seal;

the complementary cooperation means comprise a thread on the outer face of the duct and a tapping on the inner face of the skirt;

the duct has an inner face defining the passage, said inner face being substantially smooth;

the duct is substantially rectilinear;

the scraping member is integral with the finger.

The invention also relates to a cosmetic product packaging device comprising a reservoir and a dispensing head closing said reservoir, wherein the dispensing head is a dispensing head as defined above.

Furthermore, the invention relates to a cosmetic product dispensing method using a dispensing head as defined above, the method comprising the following steps:

moving the stopper into the released position, circulating the cosmetic product in the passage, and returning the stopper to the closed off position, the scraping member rubbing along its perimeter line against the duct and driving the cosmetic product present in the passage with it.

Figure 1:
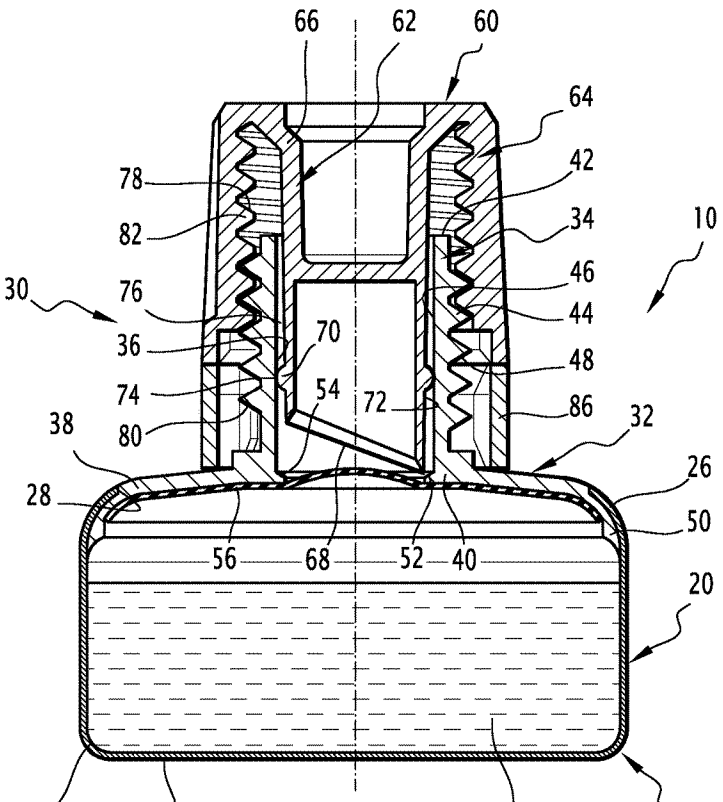
Figure 3:
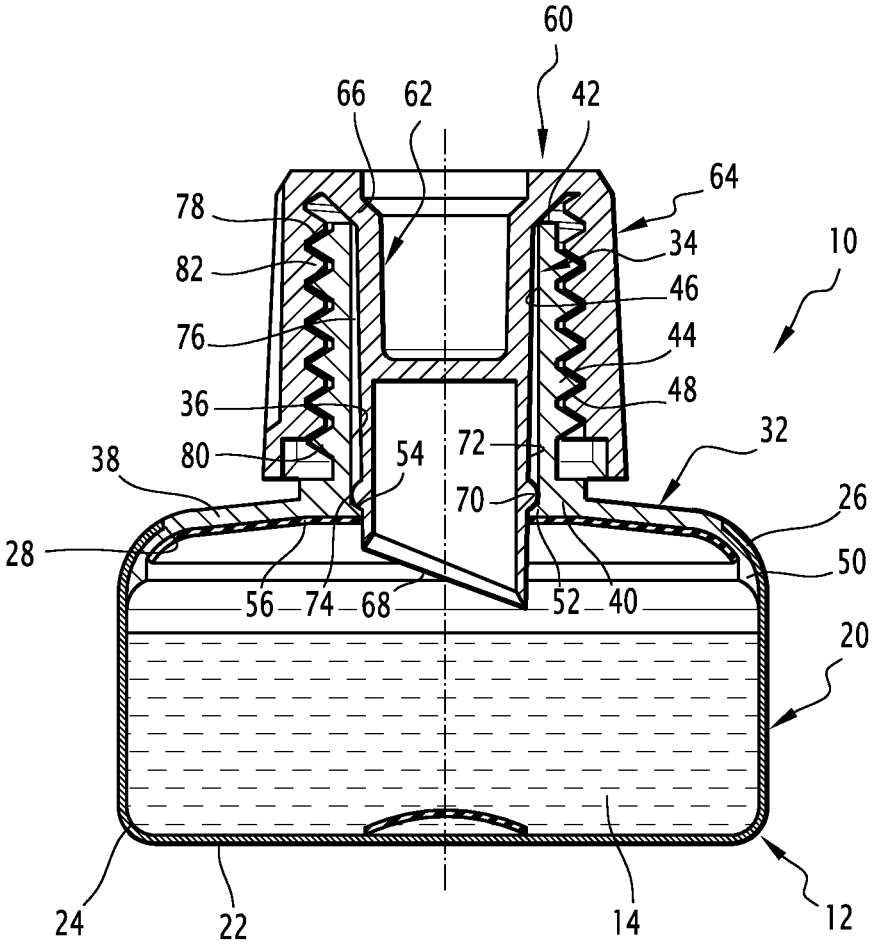

Other features and advantages of the invention will appear upon reading the following description, provided solely as an example and done in reference to the appended drawings, in which:

FIG. 1 is an axial sectional view of a cosmetic product packaging device according to the invention, prior to its first use, FIG. 2 is a view similar to FIG. 1, the stopper being in an insertion position of the stopper into the cosmetic product passage, and FIG. 3 is a view similar to FIG. 1, the stopper being in the position closing off the passage.

The packaging device 10 is intended to package a cosmetic product. It comprises a reservoir 12 containing a cosmetic product 14, typically a dye product, a hair product, a hygiene product, a face and/or body care product, a makeup product, or a sun product.

This reservoir 12 has a tubular wall 20 and a bottom 22 closing the tubular wall 20 at a first end 24. The second end 26 of the wall 20, opposite the end 24, defines an opening 28 for the exit of the cosmetic product 14 outside the reservoir 12. To that end, the opening 28 communicates with the inside and outside of the reservoir 12.

The tubular wall 20 preferably has a radial section, i.e., considered in a plane perpendicular to the axis of the tube, that is circular or oval.

The axis of the opening 28 is oriented substantially parallel to the axis of the wall 20. In particular, it is substantially combined with said axis.

In the illustrated example, the end 26 of the wall 20 is curved toward the axis of the tubular wall 20.

The packaging device 10 further comprises a dispensing head 30 closing the reservoir 12. In other words, the dispensing head 30 extends through the opening 28 so as to close off the opening 28.

The dispensing head 30 comprises a dispensing member 32 secured to the reservoir 12. This dispensing member 32 comprises a tubular duct 34 defining an axial passage 36 for the cosmetic product 14, and a skirt 38 protruding radially outward from the tubular duct 34.

The tubular duct 34 in particular has a substantially constant radial section.

In this example, the tubular duct 34 is rectilinear.

The tubular duct 34 has a connecting end 40 connecting the passage 36 to the reservoir 12, and an opposite outlet end 42 for the cosmetic product 14 to leave the packaging device 10. The passage 36 emerges inside the packaging device 10 by the end 40, and outside the packaging device 10 by the end 42.

The tubular duct 34 comprises a segment 44 extending on one side of the skirt 38. In the illustrated example, the tubular duct 34 is made up of said segment 44, i.e., the tubular duct 34 extends completely on a single side of the skirt 38. In other words, the skirt 38 protrudes from one end of the tubular duct 34, in particular from the connecting end 40.

The tubular duct 34 further has an inner face 46 defining the passage 36, and an outer face 48 oriented opposite the passage 36. The inner face 46 is smooth.

The skirt 38 is partially inserted into the reservoir 12. Its peripheral edge 50 cooperates with the second end 26 of the wall 20 to prevent the removal of the skirt 38 outside the reservoir 12. To that end, the outer face of the peripheral edge 50 is for example glued to the inner face of the second end 26.

The peripheral edge 50 is curved opposite the segment 44 of the duct 34.

The skirt 38 is substantially coaxial to the duct 34.

The dispensing member 32 further comprises an annular protrusion 52 protruding radially from the duct 34, in particular from the connecting end 40 of the duct 34, toward the inside of the passage 36. In the passage 36, it defines a shoulder 54 oriented toward the outlet end 42. In the illustrated example, said shoulder 54 has a cone trunk shape whereof the axis is the axis of the passage 36 and that narrows toward the connecting end 40.

The dispensing member 32 is preferably in a single piece.

The dispensing head 30 further comprises an airtight and fluid-tight membrane seal 56. This membrane seal 56 is overmolded tightly to the dispensing member 30 and extends across from the passage 36. It thus prevents the cosmetic product 14 from flowing outside the reservoir 12 through the passage 36, and prevents air from penetrating the reservoir 12 via the passage 36.

In the illustrated example, the membrane seal 56 is overmolded on the inner face of the skirt 38, oriented toward the inside of the reservoir 12.

Alternatively, the membrane seal 56 does not extend across from, but through the passage 36. The membrane seal 56 is then sealed to the tubular duct 34. The advantages are the same as those previously indicated.

The membrane seal 56 is in particular a plastic membrane seal or a membrane seal associating a plastic material with metal.

The dispensing head 30 further comprises a stopper 60. This stopper 60 is movable between a position freeing the passage 36, in which in particular the stopper 60 is separated from the duct 34, to allow the cosmetic product 14 to exit through the passage 36, and a position closing of the passage 36, in which in particular the stopper 60 extends through the passage 36, to prevent the cosmetic product 14 from exiting through the passage 36.

The stopper 60 is shown in its closing off position in FIG. 3. In this closing off position, the stopper 60 closes off the passage 36 so as to be airtight and liquid-tight.

The stopper 60 is preferably in a single piece. It comprises a hollow finger 62 and a skirt 64 substantially coaxial with the finger 62 and extending around the finger 62.

The finger 62 is suitable for extending to the inside of the passage 36 when the stopper 60 is in the closing off position. To that end, the outer diameter of the finger 62 is smaller than the diameter of the passage 36.

The finger 62 has a junction end 66 to the skirt 64, and a free end 68. The free end 68 is suitable for perforating the membrane seal 56 when the stopper 60 is in the closing off position. This makes it possible to free the passage 36 to allow the cosmetic product 14 to exit through the passage 36. To that end, the free end 68 is at a distance from the junction end 66 greater than the axial length of the passage 36. Furthermore, the free end 68 is beveled, so as to facilitate the perforation of the membrane seal 56.

The finger 62 further bears a peripheral scraping member 70, protruding radially outward from a peripheral face 72 of the finger 62. This scraping member 70 in particular has a diameter substantially equal to the diameter of the passage 36.

The scraping member 70 has a perimeter line 74 suitable for being fully in contact with the duct 34 when the finger 62 extends in the passage 36. This perimeter line 74 is in particular closed and continuous.

The perimeter line 74 preferably extends, as shown, in radial plane substantially perpendicular to the axis of the finger 62.

In the illustrated example, the scraping member 70 is an annular lip coaxial to the finger 62 and extending around the finger 62. Said lip has a thickness substantially equal to the width of the annular interval 76 left free between the finger 62 and the duct 34 when the stopper 60 is in the closing off position. The perimeter line 74 is formed by the free edge of the lip.

The perimeter line 74 is closer to the free end 68 of the finger 62 than the junction end 66.

The distance from the scraping member 70 to the free end 68 is in particular chosen such that the scraping member 70 is in contact with the shoulder 54 along a closed contour line when the stopper 60 is in the closing off position.

The scraping member 70 is preferably integral with the finger 62.

The skirt 64 is suitable for extending around the duct 34 when the stopper 60 is in the closing off position. To that end, the inner diameter of the skirt 64 is larger than the outer diameter of the duct 34.

The skirt 64 has an inner face 78 oriented toward the finger 62. This inner face 78 has, with the outer face 48 of the duct 34, complementary cooperation means 80, 82 for securing the stopper 60 to the dispensing member 32 when the stopper 60 is in the closing off position. In the illustrated example, these complementary means 80, 82 comprise a thread 80 on the outer face 48 of the duct 34 and a tapping 82 on the inner face 78 of the skirt 64.

The dispensing head 30 further comprises a removable safety ring 86 suitable for keeping the stopper 60 in an intermediate position (FIG. 1) between its closing off and free positions, in which the finger 62 is engaged in the passage 36, its free end 68 being at a distance from the membrane seal 56. This makes it possible to prevent the membrane seal 56 from being accidentally pierced before the first use of the cosmetic product 14. The cosmetic product 14 is thus better preserved from oxidation.

The safety ring 86 is fastened by frangible fastening means (not shown) to the free edge 88 of the skirt 64 and to the dispensing member 32. It surrounds the duct 34 and is inserted between the skirt 64 of the stopper 60 and the skirt 38 of the dispensing member 32. The ring 86 thus makes any movement of the stopper 60 toward the membrane seal 56 impossible. Furthermore, owing to the frangible fastening means, it keeps the stopper 60 attached to the dispensing member 32, which prevents loss of the stopper 60.

The packaging device 10 is used as described below.

First, the packaging device 10 is provided with the safety ring 86 keeping the stopper 60 in its intermediate position, as illustrated in FIG. 1.

The user begins by retaining the stopper 60 so as to unscrew it. In so doing, he stresses the frangible fastening means of the ring 86, which break. The stopper 60 is moved into the released position, and the user finishes detaching the ring 86 from the element to which it was still attached.

The stopper 60 is next repositioned on the dispensing member 32, as illustrated in FIG. 2. During this repositioning, the finger 62 of the stopper 60 is inserted into the passage 36 through the outlet end 42 of the duct 34.

The stopper 60 is then screwed on the dispensing member 32, until reaching its closing off position. In so doing, the free end 68 of the finger 62 bears on the membrane seal 56 and, owing to the tapering of the beveled free end 68 and the rotation of the stopper 60, the membrane seal 56 gives way. In particular, a portion of the membrane seal 56 is cut and falls to the bottom of the reservoir 12.

The cosmetic product 14 is then ready to be used.

To that end, the user again unscrews the stopper 60 until it is brought into the released position, then tilts the device 10 to pour the cosmetic product 14 outside the packaging device 10.

Once the desired dose of product 14 has been poured, the stopper 60 is placed back on the dispensing member 32, then re-screwed in the closing off position. In so doing, the scraping member 70 runs along its perimeter line 74 against the duct 34 and drives with it, toward the reservoir 12, the cosmetic product that was deposited inside the passage 36.

By bearing against the shoulder 54 at the end of travel, the scraping member 70 provides good sealing with respect to the air and fluids. The cosmetic product 14 remaining in the reservoir 12 thus remains sheltered from oxidation, despite the break of the membrane seal 56.

Owing to the invention described above, the cosmetic product 14 is better protected from oxidation. In particular, the oxidation of cosmetic product having remained in the passage 36 is prevented.

Furthermore, this advantage is obtained without the changes made to the packaging device 10 causing a significant increase in its production costs.

The invention claimed is:

1. A cosmetic product dispensing head, comprising:

a dispensing member for the cosmetic product, having a tubular duct defining a passage for the cosmetic product, the duct having an outer face oriented opposite the passage, and a stopper for closing off the passage, movable between a position freeing the passage and a position closing off the passage, the stopper comprising a finger extending in the passage when the stopper is in the closing off position and a skirt extending around the duct when the stopper is in the closing off position, the skirt having an inner face oriented toward the finger, the outer face of the duct and the inner face of the skirt having complementary cooperating elements for securing the stopper to the dispensing member, in which the finger bears a peripheral scraping member protruding radially from a peripheral face of the finger, the scraping member having at least one perimeter line suitable for being in contact with the duct when the stopper is in the closing off position, wherein the dispensing member has an annular protrusion protruding radially from the duct toward the inside of the passage, the protrusion defining a shoulder, and the scraping member is suitable for being in contact with said shoulder along a closed contour line when the stopper is in the closing off position, and wherein the duct has an insertion end for inserting the finger into the passage and a connecting end for connecting the passage to a cosmetic product reservoir, opposite the insertion end, the annular protrusion protruding from said connecting end, the scraping member having a perimeter line suitable for being fully in contact with the duct for any position of the stopper in which the scrapping member is engaged in the passage.

2. The dispensing head according to claim 1, wherein the finger has a junction end to the skirt and a free end, and the perimeter line is closer to the free end than the junction end.

3. The dispensing head according to claim 1, comprising an airtight and fluid-tight membrane seal tightly sealed to the dispensing member, the membrane seal being separate from the stopper, the membrane seal extending through or across from the passage.

4. The dispensing head according to claim 3, wherein the finger has a junction end to the skirt and a free end, the free end being suitable for perforating the membrane seal when the stopper is in the closing off position.

5. The dispensing head according to claim 4, wherein the free end is beveled so as to facilitate the perforation of the membrane seal.

6. The dispensing head according to claim 4, comprising a removable safety member suitable for keeping the stopper in an intermediate position between its released and closing off positions, in which the free end of the finger is at a distance from the membrane seal.

7. The dispensing head according to claim 1, wherein the complementary cooperating elements comprise a thread on the outer face of the duct and a tapping—on the inner face of the skirt.

8. The dispensing head according to claim 1, wherein the duct has an inner face defining the passage, said inner face being substantially smooth.

9. The dispensing head according to claim 1, wherein the duct is substantially rectilinear.

10. The dispensing head according to claim 1, wherein the scraping member is made in one piece together with the finger.

11. A cosmetic product packaging device, comprising a reservoir containing a cosmetic product and a dispensing head closing said reservoir, wherein the dispensing head is a dispensing head according to claim 1.

12. A method for dispensing a cosmetic product using a dispensing head according to claim 1, which comprises the following successive steps:

moving the stopper into the released position, circulating the cosmetic product in the passage, and returning the stopper to the closed off position, the scraping member rubbing along its perimeter line against the duct and driving the cosmetic product present in the passage with it.

13. The dispensing head according to claim 2, comprising an airtight and fluid-tight membrane seal tightly sealed to the dispensing member, the membrane seal being separate from the stopper, the membrane seal extending through or across from the passage.

14. The dispensing head according to claim 5, comprising a removable safety member suitable for keeping the stopper in an intermediate position between its released and closing off positions, in which the free end of the finger is at a distance from the membrane seal.

* * * * *